US007312762B2

(12) United States Patent
Puente Ballarda et al.

(10) Patent No.: US 7,312,762 B2
(45) Date of Patent: Dec. 25, 2007

(54) LOADED ANTENNA

(75) Inventors: Carles Puente Ballarda, Barcelona (ES); Jordi Soler Castany, Barcelona (ES)

(73) Assignee: Fractus, S.A., Barcelona (ES)

( * ) Notice: Subject to any disclaimer, the term of this patent is extended or adjusted under 35 U.S.C. 154(b) by 479 days.

(21) Appl. No.: 10/822,933

(22) Filed: Apr. 13, 2004

(65) Prior Publication Data

US 2006/0077101 A1 Apr. 13, 2006

Related U.S. Application Data

(63) Continuation of application No. PCT/EP01/11914, filed on Oct. 16, 2001.

(30) Foreign Application Priority Data

Oct. 16, 2001 (EP) ..... PCT/EP2001/11914

(51) Int. Cl.
*H01Q 9/42* (2006.01)

(52) U.S. Cl. ..... 343/752; 343/792.5

(58) Field of Classification Search ..... 343/700 MS, 343/745, 795, 861, 752, 792.5
See application file for complete search history.

(56) References Cited

U.S. PATENT DOCUMENTS

| | | | |
|---|---|---|---|
| 3,521,284 | A | 7/1970 | Shelton, Jr. et al. |
| 3,599,214 | A | 8/1971 | Altmayer |
| 3,622,890 | A | 11/1971 | Fujimoto et al. |
| 3,683,376 | A | 8/1972 | Pronovost |
| 3,818,490 | A | 6/1974 | Leahy |
| 3,967,276 | A | 6/1976 | Goubau |
| 3,969,730 | A | 7/1976 | Fuchser |
| 4,024,542 | A | 5/1977 | Ikawa et al. |
| 4,072,951 | A | 2/1978 | Kaloi |
| 4,131,893 | A | 12/1978 | Munson et al. |
| 4,141,016 | A | 2/1979 | Nelson |
| 4,471,358 | A | 9/1984 | Glasser |
| 4,471,493 | A | 9/1984 | Schober |
| 4,504,834 | A | 3/1985 | Garay et al. |
| 4,543,581 | A | 9/1985 | Nemet |
| 4,571,595 | A | 2/1986 | Phillips et al. |
| 4,584,709 | A | 4/1986 | Kneisel et al. |
| 4,590,614 | A | 5/1986 | Erat |
| 4,623,894 | A | 11/1986 | Lee et al. |
| 4,673,948 | A | 6/1987 | Kuo |

(Continued)

FOREIGN PATENT DOCUMENTS

| | | |
|---|---|---|
| DE | 3337941 | 5/1985 |

(Continued)

OTHER PUBLICATIONS

Ali, M. et al., "A Triple-Band Internal Antenna for Mobile Hand-held Terminals," IEEE, pp. 32-35 (1992).

(Continued)

*Primary Examiner*—Michael C. Wimer
(74) *Attorney, Agent, or Firm*—Winstead PC

(57) ABSTRACT

A novel loaded antenna is defined in the present invention. The radiating element of the loaded antenna consists of two different parts: a conducting surface and a loading structure. By means of this configuration, the antenna provides a small and multiband performance, and hence it features a similar behaviour through different frequency bands.

21 Claims, 16 Drawing Sheets

U.S. PATENT DOCUMENTS

| | | | | |
|---|---|---|---|---|
| 4,730,195 | A | | 3/1988 | Phillips et al. |
| 4,839,660 | A | | 6/1989 | Hadzoglou |
| 4,843,468 | A | | 6/1989 | Drewery |
| 4,847,629 | A | | 7/1989 | Shimazaki |
| 4,849,766 | A | | 7/1989 | Inaba et al. |
| 4,857,939 | A | | 8/1989 | Shimazaki |
| 4,890,114 | A | | 12/1989 | Egashira |
| 4,894,663 | A | | 1/1990 | Urbish et al. |
| 4,907,011 | A | | 3/1990 | Kuo |
| 4,912,481 | A | | 3/1990 | Mace et al. |
| 4,975,711 | A | | 12/1990 | Lee |
| 5,030,963 | A | | 7/1991 | Tadama |
| 5,138,328 | A | | 8/1992 | Zibrik et al. |
| 5,168,472 | A | | 12/1992 | Lockwood |
| 5,172,084 | A | | 12/1992 | Fiedzuiszko et al. |
| 5,200,756 | A | | 4/1993 | Feller |
| 5,214,434 | A | | 5/1993 | Hsu |
| 5,218,370 | A | | 6/1993 | Blaese |
| 5,227,804 | A | | 7/1993 | Oda |
| 5,227,808 | A | | 7/1993 | Davis |
| 5,245,350 | A | | 9/1993 | Sroka |
| 5,248,988 | A | | 9/1993 | Makino |
| 5,255,002 | A | | 10/1993 | Day |
| 5,257,032 | A | | 10/1993 | Diamond et al. |
| 5,347,291 | A | | 9/1994 | Moore |
| 5,355,144 | A | | 10/1994 | Walton et al. |
| 5,355,318 | A | | 10/1994 | Dionnet et al. |
| 5,373,300 | A | | 12/1994 | Jenness et al. |
| 5,402,134 | A | | 3/1995 | Miller et al. |
| 5,410,322 | A | * | 4/1995 | Sonoda ..... 343/700 MS |
| 5,420,599 | A | | 5/1995 | Erkocevic |
| 5,422,651 | A | | 6/1995 | Chang |
| 5,451,965 | A | | 9/1995 | Matsumoto |
| 5,451,968 | A | | 9/1995 | Emery |
| 5,453,751 | A | | 9/1995 | Tsukamoto et al. |
| 5,457,469 | A | | 10/1995 | Diamond et al. |
| 5,471,224 | A | | 11/1995 | Barkeshli |
| 5,493,702 | A | | 2/1996 | Crowley et al. |
| 5,495,261 | A | | 2/1996 | Baker et al. |
| 5,534,877 | A | | 7/1996 | Sorbello et al. |
| 5,537,367 | A | | 7/1996 | Lockwood et al. |
| 5,684,672 | A | | 11/1997 | Karidis et al. |
| 5,712,640 | A | | 1/1998 | Andou et al. |
| 5,767,811 | A | | 6/1998 | Mandai et al. |
| 5,798,688 | A | | 8/1998 | Schofield |
| 5,821,907 | A | | 10/1998 | Zhu et al. |
| 5,841,403 | A | | 11/1998 | West |
| 5,847,682 | A | | 12/1998 | Ke |
| 5,870,066 | A | | 2/1999 | Asakura et al. |
| 5,872,546 | A | | 2/1999 | Ihara et al. |
| 5,898,404 | A | | 4/1999 | Jou |
| 5,903,240 | A | | 5/1999 | Kawahata et al. |
| 5,926,141 | A | | 7/1999 | Lindenmeier et al. |
| 5,929,825 | A | | 7/1999 | Niu et al. |
| 5,943,020 | A | | 8/1999 | Liebendoerfer et al. |
| 5,966,098 | A | | 10/1999 | Qi et al. |
| 5,973,651 | A | | 10/1999 | Suesada et al. |
| 5,986,610 | A | | 11/1999 | Miron |
| 5,990,838 | A | | 11/1999 | Burns et al. |
| 6,002,367 | A | | 12/1999 | Engblom et al. |
| 6,028,568 | A | | 2/2000 | Asakura et al. |
| 6,031,499 | A | | 2/2000 | Dichter |
| 6,031,505 | A | | 2/2000 | Qi et al. |
| 6,078,294 | A | | 6/2000 | Mitarai |
| 6,091,365 | A | | 7/2000 | Derneryd et al. |
| 6,097,345 | A | | 8/2000 | Walton |
| 6,104,349 | A | | 8/2000 | Cohen |
| 6,127,977 | A | | 10/2000 | Cohen |
| 6,131,042 | A | | 10/2000 | Lee et al. |
| 6,140,969 | A | | 10/2000 | Lindenmeier et al. |
| 6,140,975 | A | | 10/2000 | Cohen |
| 6,160,513 | A | | 12/2000 | Davidson et al. |
| 6,166,694 | A | | 12/2000 | Ying |
| 6,172,618 | B1 | | 1/2001 | Hakozaki et al. |
| 6,211,824 | B1 | | 4/2001 | Holden et al. |
| 6,218,992 | B1 | | 4/2001 | Sadler et al. |
| 6,236,372 | B1 | | 5/2001 | Lindenmeier et al. |
| 6,266,023 | B1 | | 7/2001 | Nagy et al. |
| 6,268,831 | B1 | | 7/2001 | Sanford |
| 6,268,836 | B1 | | 7/2001 | Faulkner et al. |
| 6,281,846 | B1 | | 8/2001 | Puente Baliarda et al. |
| 6,307,511 | B1 | | 10/2001 | Ying et al. |
| 6,329,951 | B1 | | 12/2001 | Wen et al. |
| 6,329,954 | B1 | | 12/2001 | Fuchs et al. |
| 6,329,962 | B2 | | 12/2001 | Ying |
| 6,337,667 | B1 | | 1/2002 | Ayala et al. |
| 6,343,208 | B1 | | 1/2002 | Ying |
| 6,362,790 | B1 | | 3/2002 | Proctor, Jr. et al. |
| 6,367,939 | B1 | | 4/2002 | Carter et al. |
| 6,392,610 | B1 | | 5/2002 | Braun et al. |
| 6,407,710 | B2 | | 6/2002 | Keilen et al. |
| 6,408,190 | B1 | | 6/2002 | Ying et al. |
| 6,417,810 | B1 | | 7/2002 | Huels et al. |
| 6,431,712 | B1 | | 8/2002 | Turnbull |
| 6,445,352 | B1 | | 9/2002 | Cohen |
| 6,452,549 | B1 | | 9/2002 | Lo |
| 6,452,553 | B1 | | 9/2002 | Cohen |
| 6,459,413 | B1 | | 10/2002 | Tseng et al. |
| 6,476,766 | B1 | | 11/2002 | Cohen |
| 6,525,691 | B2 | | 2/2003 | Varadan et al. |
| 6,535,175 | B2 | | 3/2003 | Brady et al. |
| 6,552,690 | B2 | | 4/2003 | Veerasamy |
| 6,657,593 | B2 | | 12/2003 | Nagumo et al. |
| 6,680,705 | B2 | | 1/2004 | Tan et al. |
| 6,717,551 | B1 | | 4/2004 | Desclos et al. |
| 6,756,946 | B1 | | 6/2004 | Deng et al. |
| 6,864,854 | B2 | | 3/2005 | Dai et al. |
| 7,019,695 | B2 | | 3/2006 | Cohen |
| 2002/0000940 | A1 | | 1/2002 | Moren et al. |
| 2002/0000942 | A1 | | 1/2002 | Duroux |
| 2002/0036594 | A1 | | 3/2002 | Gynes |
| 2002/0105468 | A1 | | 8/2002 | Tessier et al. |
| 2002/0109633 | A1 | | 8/2002 | Ow et al. |
| 2002/0126054 | A1 | | 9/2002 | Fuerst et al. |
| 2002/0126055 | A1 | | 9/2002 | Lindenmeier et al. |
| 2002/0175866 | A1 | | 11/2002 | Gram |
| 2004/0056804 | A1 | | 3/2004 | Kadambi et al. |
| 2004/0095281 | A1 | | 5/2004 | Poilasne et al. |
| 2004/0119644 | A1 | | 6/2004 | Puente-Baliarda et al. |

FOREIGN PATENT DOCUMENTS

| | | |
|---|---|---|
| EP | 0096847 | 12/1983 |
| EP | 0297813 | 6/1988 |
| EP | 0358090 | 8/1989 |
| EP | 0543645 | 5/1993 |
| EP | 0571124 | 11/1993 |
| EP | 0688040 | 12/1995 |
| EP | 0765001 | 3/1997 |
| EP | 0814536 | 12/1997 |
| EP | 0871238 | 10/1998 |
| EP | 0892459 | 1/1999 |
| EP | 0929121 | 7/1999 |
| EP | 0932219 | 7/1999 |
| EP | 0969375 | 1/2000 |
| EP | 0986130 | 3/2000 |
| EP | 0942488 | 4/2000 |
| EP | 0997974 | 5/2000 |
| EP | 1018777 | 7/2000 |
| EP | 1018779 | 7/2000 |
| EP | 1071161 | 1/2001 |
| EP | 1079462 | 2/2001 |
| EP | 1083624 | 3/2001 |
| EP | 1094545 | 4/2001 |

| | | |
|---|---|---|
| EP | 1096602 | 5/2001 |
| EP | 1148581 | 10/2001 |
| EP | 1198027 | 4/2002 |
| EP | 1237224 | 9/2002 |
| EP | 1267438 | 12/2002 |
| EP | 0843905 | 12/2004 |
| ES | 2112163 | 3/1998 |
| ES | 2142280 | 5/1998 |
| FR | 2543744 | 10/1984 |
| FR | 2704359 | 10/1994 |
| GB | 2215136 | 9/1989 |
| GB | 2330951 | 5/1999 |
| GB | 2355116 | 4/2001 |
| JP | 55147806 | 11/1980 |
| JP | 5007109 | 1/1993 |
| JP | 5129816 | 5/1993 |
| JP | 5267916 | 10/1993 |
| JP | 5347507 | 12/1993 |
| JP | 6204908 | 7/1994 |
| JP | 10209744 | 8/1998 |
| WO | 9511530 | 4/1995 |
| WO | 9627219 | 9/1996 |
| WO | 9629755 | 9/1996 |
| WO | 9638881 | 12/1996 |
| WO | 9706578 | 2/1997 |
| WO | 9711507 | 3/1997 |
| WO | 9732355 | 9/1997 |
| WO | 9733338 | 9/1997 |
| WO | 9735360 | 9/1997 |
| WO | 9747054 | 12/1997 |
| WO | 9812771 | 3/1998 |
| WO | 9836469 | 8/1998 |
| WO | 9903166 | 1/1999 |
| WO | 9903167 | 1/1999 |
| WO | 9925042 | 5/1999 |
| WO | 9927608 | 6/1999 |
| WO | 9956345 | 11/1999 |
| WO | 0001028 | 1/2000 |
| WO | 0003453 | 1/2000 |
| WO | 0022695 | 4/2000 |
| WO | 0036700 | 6/2000 |
| WO | 0049680 | 8/2000 |
| WO | 0052784 | 9/2000 |
| WO | 0052787 | 9/2000 |
| WO | 0103238 | 1/2001 |
| WO | 0108257 | 2/2001 |
| WO | 0113464 | 2/2001 |
| WO | WO-01/08257 | 2/2001 |
| WO | 0117064 | 3/2001 |
| WO | 0122528 | 3/2001 |
| WO | 0124314 | 4/2001 |
| WO | 0126182 | 4/2001 |
| WO | 0128035 | 4/2001 |
| WO | 0131739 | 5/2001 |
| WO | 0133665 | 5/2001 |
| WO | 0135491 | 5/2001 |
| WO | 0137369 | 5/2001 |
| WO | 0137370 | 5/2001 |
| WO | 0141252 | 6/2001 |
| WO | 0148861 | 7/2001 |
| WO | 0154225 | 7/2001 |
| WO | 0173890 | 10/2001 |
| WO | 0178192 | 10/2001 |
| WO | WO-01/78192 | 10/2001 |
| WO | 0182410 | 11/2001 |
| WO | 0235646 | 5/2002 |
| WO | WO-02/35652 | 5/2002 |
| WO | 02091518 | 11/2002 |
| WO | 02096166 | 11/2002 |
| WO | WO-03/034544 | 4/2003 |
| WO | WO-2004/027922 | 4/2004 |

OTHER PUBLICATIONS

Romeu, Jordi et al., "A Three Dimensional Hilbert Antenna," IEEE, pp. 550-553 (2002).

Parker et al., "Microwaves, Antennas & Propagation," IEEE Proceedings H, pp. 19-22 (Feb. 1991).

Hansen, R.C., "Fundamental Limitations in Antennas," Proceedings of the IEEE, vol. 69, No. 2, pp. 170-182 (Feb. 1981).

Jaggard, Dwight L., "Fractal Electrodynamics and Modeling," Directions in Electromagnetic Wave Modeling, pp. 435-446 (1991).

Hohlfeld, Robert G. et al., "Self-Similarity and the Geometric Requirements for Frequency Independence in Antennae," Fractals, vol. 7, No. 1, pp. 79-84 (1999).

Samavati, Hirad, et al., "Fractal Capacitors," IEEE Journal of Solid-State Circuits, vol. 33, No. 12, pp. 2035-2041 (Dec. 1998).

Pribetich, P., et al., "Quasifractal Planar Microstrip Resonators for Microwave Circuits," Microwave and Optical Technology Letters, vol. 21, No. 6, pp. 433-436 (Jun. 20, 1999).

Zhang, Dawei, et al., "Narrowband Lumped-Element Microstrip Filters Using Capacitively-Loaded Inductors," IEEE MTT-S Microwave Symposium Digest, pp. 379-382 (May 16, 1995).

Gough, C.E., et al., "High Tc coplanar resonators for microwave applications and scientific studies," Physica C, NL, North-Holland Publishing, Amsterdam, vol. 282-287, No. 2001, pp. 395-398 (Aug. 1, 1997).

Radio Engineering Reference—Book by H. Meinke and F.V. Gundlah, vol. I, Radio components. Circuits with lumped parameters. Transmission lines. Wave-guides. Resonators. Arrays. Radio waves propagation, States Energy Publishing House, Moscow, with English translation (1961) [4 pp.].

V.A. Volgov, "Parts and Units of Radio Electronic Equipment (Design & Computation)," Energiya, Moscow, with English translation (1967) [4 pp.].

Puente, C., et al., "Multiband properties of a fractal tree antenna generated by electrochemical deposition," Electronics Letters, IEE Stevenage, GB, vol. 32, No. 25, pp. 2298-2299 (Dec. 5, 1996).

Puente, C., et al., "Small but long Koch fractal monopole," Electronics Letters, IEE Stevenage, GB. vol. 34, No. 1, pp. 9-10 (Jan. 8, 1998).

Puente Baliarda, Carles, et al., "The Koch Monopole: A Small Fractal Antenna," IEEE Transactions on Antennas and Propagation, New York, US, vol. 48, No. 11, pp. 1773-1781 (Nov. 1, 2000).

Cohen, Nathan, "Fractal Antenna Applications in Wireless Telecommunications," Electronics Industries Forum of New England, 1997. Professional Program Proceedings Boston, MA US, May 6-8, 1997, New York, NY US, IEEE, US pp. 43-49 (May 6, 1997).

Anguera, J: et al. "Miniature Wideband Stacked Microstrip Patch Antenna Based on the Sierpinski Fractal Geometry," IEEE Antennas and Propagation Society International Symposium, 2000 Digest. Aps., vol. 3 of 4, pp. 1700-1703 (Jul. 16, 2000).

Hara Prasad, R.V., et al., "Microstrip Fractal Patch Antenna for Multi-Band Communication," Electronics Letters, IEE Stevenage, GB, vol. 36, No. 14, pp. 1179-1180 (Jul. 6, 2000).

Borja, C. et al., "High Directivity Fractal Boundary Microstrip Patch Antenna," Electronics Letters. IEE Stevenage, GB, vol. 36, No. 9, pp. 778-779 (Apr. 27, 2000).

Sanad, Mohamed, "A Compact Dual-Broadband Microstrip Antenna Having Both Stacked and Planar Parasitic Elements," IEEE Antennas and Propagation Society International Symposium 1996 Digest, Jul. 21-26, 1996, pp. 6-9.

Deng, Sheng-Ming, "A T-Strip Loaded Rectangular Microstrip Patch Antenna for Dual-Frequency Operation", IEEE AP-S International Symposium and USNC/URSI, Jul. 11-16, 1999, 5 pages.

Castany, Jordi Soler, "Novel Multifrequency and Small Monopole Antenna Techniques for Wireless and Mobile Applications", Dissertation, Electomagnetics and Photonics Engineering Group. Fractus, Dec. 2004.

Kandoian, Armig G., "Three New Antenna Types and Their Applications", Waves and Electrons, Feb. 1946, pp. 70-75.

Dou, Weiping et al., "Small Broadband Stacked Planar Monopole", Microwave and Optical Technology Letters, vol. 27, No.4, Nov. 20, 2000, pp. 288-289.
Dou et al. Small broadband stacked planar monopole. Microwave and Optical Technology Letters. 2000, vol. 27, No. 4.
Reed, Antenna patch reduction by inductive and capacitive loading, IEEE Antennas and Propagation Symposium, 2000.
Reed et al. Patch antenna size reductions by means of inductive slots, Microwave and Optical Technology Letters, 2001, vol. 29, No. 2.
Cetiner et al. Reconfigurable miniature multielement antenna for wireless networking. IEEE Radio and Wireless Conference, 2001.

* cited by examiner

LOADED ANTENNA

Continuation of prior PCT application No.: EP01/11914 filed Oct. 16, 2001.

OBJECT OF THE INVENTION

The present invention relates to a novel loaded antenna which operates simultaneously at several bands and featuring a smaller size with respect to prior art antennas.

The radiating element of the novel loaded antenna consists on two different parts: a conducting surface with a polygonal, space-filling or multilevel shape; and a loading structure consisting on a set of strips connected to said first conducting surface.

The invention refers to a new type of loaded antenna which is mainly suitable for mobile communications or in general to any other application where the integration of telecom systems or applications in a single small antenna is important.

BACKGROUND OF THE INVENTION

The growth of the telecommunication sector, and in particular, the expansion of personal mobile communication systems are driving the engineering efforts to develop multiservice (multifrequency) and compact systems which require multifrequency and small antennas. Therefore, the use of a multisystem small antenna with a multiband and/or wideband performance, which provides coverage of the maximum number of services, is nowadays of notable interest since it permits telecom operators to reduce their costs and to minimize the environmental impact.

Most of the multiband reported antenna solutions use one or more radiators or branches for each band or service. An example is found in U.S. patent Ser. No. 09/129,176 entitled "Multiple band, multiple branch antenna for mobile phone".

One of the alternatives which can be of special interest when looking for antennas with a multiband and/or small size performance are multilevel antennas, Patent publication WO01/22528 entitled "Multilevel Antennas", and miniature space-filling antennas, Patent publication WO01/54225 entitled "Space-filling miniature antennas". In particular in the publication WO 01/22528 a multilevel antennae was characterised by a geometry comprising polygons or polyhedrons of the same class (same number of sides of faces), which are electromagnetically coupled and grouped to form a larger structure. In a multilevel geometry most of these elements are clearly visible as their arwea of contact, intersection or interconnection (if these exists) with other elements is always less than 50% of their perimeter or area in at least 75% of the polygons or polyhedrons.

In the publication WO 01/54225 a space-filling miniature antenna was defined as an antenna havinf at least one part shaped as a space-filling-curve (SFC), being defined said SFC as a curve composed by at least ten connected straight segments, wherein said segments are smaller than a tenth of the operating free-space wave length and they are spacially arranged in such a way that none of said adjacent and connected segments from another longer straight segment.

The international publication WO 97/06578 entitled fractal antennas, resonators and loading elements, describe fractal-shaped elements which may be used to form an antenna.

A variety of techniques used to reduce the size of the antennas can be found in the prior art. In 1886, there was the first example of a loaded antenna; that was, the loaded dipole which Hertz built to validate Maxwell equations.

A. G. Kandoian (A. G. Kandoian, Three new antenna types and their applications, Proc. IRE, vol. 34, pp. 70W-75W, February 1946) introduced the concept of loaded antennas and demonstrated how the length of a quarter wavelength monopole can be reduced by adding a conductive disk at the top of the radiator. Subsequently, Goubau presented an antenna structure top-loaded with several capacitive disks interconnected by inductive elements which provided a smaller size with a broader bandwith, as is illustrated in U.S. Pat. No. 3,967,276 entitled "Antenna structures having reactance at free end".

More recently, U.S. Pat. No. 5,847,682 entitled "Top loaded triangular printed antenna" discloses a triangular-shaped printed antenna with its top connected to a rectangular strip. The antenna features a low-profile and broadband performance. However, none of these antenna configurations provide a multiband behaviour. In Patent No. WO0122528 entitled "Multilevel Antennas", another patent of the present inventors, there is a particular case of a top-loaded antenna with an inductive loop, which was used to miniaturize an antenna for a dual frequency operation. Also, W. Dou and W. Y. M. Chia (W. Dou and W. Y. M. Chia, "Small broadband stacked planar monopole", Microwave and Optical Technology Letters, vol. 27, pp. 288-289, November 2000) presented another particular antecedent of a top-loaded antenna with a broadband behavior. The antenna was a rectangular monopole top-loaded with one rectangular arm connected at each of the tips of the rectangular shape. The width of each of the rectangular arms is on the order of the width of the fed element, which is not the case of the present invention.

SUMMARY OF THE INVENTION

The key point of the present invention is the shape of the radiating element of the antenna, which consists on two main parts: a conducting surface and a loading structure. Said conducting surface has a polygonal, space-filling or multilevel shape and the loading structure consists on a conducting strip or set of strips connected to said conducting surface. According to the present invention, at least one loading strip must be directly connected at least at one point on the perimeter of said conducting surface. Also, circular or elliptical shapes are included in the set of possible geometries of said conducting surfaces since they can be considered polygonal structures with a large number of sides.

Due to the addition of the loading structure, the antenna can feature a small and multiband, and sometimes a multiband and wideband, performance. Moreover, the multiband properties of the loaded antenna (number of bands, spacing between bands, matching levels, etc) can be adjusted by modifying the geometry of the load and/or the conducting surface.

This novel loaded antenna allows to obtain a multifrequency performance, obtaining similar radioelectric parameters at several bands.

The loading structure can consist for instance on a single conducting strip. In this particular case, said loading strip must have one of its two ends connected to a point on the perimeter of the conducting surface (i.e., the vertices or edges). The other tip of said strip is left free in some embodiments while, in other embodiments it is also connected at a point on the perimeter of said conducting surface.

The loading structure can include not only a single strip but also a plurality of loading strips located at different locations along its perimeter.

The geometries of the loads that can be connected to the conducting surface according to the present invention are:

a) A curve composed by a minimum of two segments and a maximum of nine segments which are connected in such a way that each segment forms an angle with their neighbours, i.e., no pair of adjacent segments define a larger straight segment.
b) A straight segment or strip
c) A straight strip with a polygonal shape
d) A space-filling curve, Patent No. PCT/EP00/00411 entitled "Space-filling miniature antennas".

In some embodiments, the loading structure described above is connected to the conducting surface while in other embodiments, the tips of a plurality of the loading strips are connected to other strips. In those embodiments where a new loading strip is added to the previous one, said additional load can either have one tip free of connection, or said tip connected to the previous loading strip, or both tips connected to previous strip or one tip connected to previous strip and the other tip connected to the conducting surface.

There are three types of geometries that can be used for the conducting surface according to the present invention:

a) A polygon (i.e., a triangle, square, trapezoid, pentagon, hexagon, etc. or even a circle or ellipse as a particular case of polygon with a very large number of edges).
b) A multilevel structure, Patent No. WO0122528 entitled "Multilevel Antennas".
c) A solid surface with an space-filling perimeter.

In some embodiments, a central portion of said conducting surface is even removed to further reduce the size of the antenna. Also, it is clear to those skilled in the art that the multilevel or space-filling designs in configurations b) and c) can be used to approximate, for instance, ideal fractal shapes.

FIG. 1 and FIG. 2 show some examples of the radiating element for a loaded antenna according to the present invention. In drawings 1 to 3 the conducting surface is a trapezoid while in drawings 4 to 7 said surface is a triangle. It can be seen that in these cases, the conducting surface is loaded using different strips with different lengths, orientations and locations around the perimeter of the trapezoid, FIG. 1. Besides, in these examples the load can have either one or both of its ends connected to the conducting surface, FIG. 2.

The main advantage of this novel loaded antenna is two-folded:

The antenna features a multiband or wideband performance, or a combination of both.

Given the physical size of radiating element, said antenna can be operated at a lower frequency than most of the prior art antennas.

DETAILED DESCRIPTION OF SOME PREFERRED EMBODIMENTS

Figure 1:
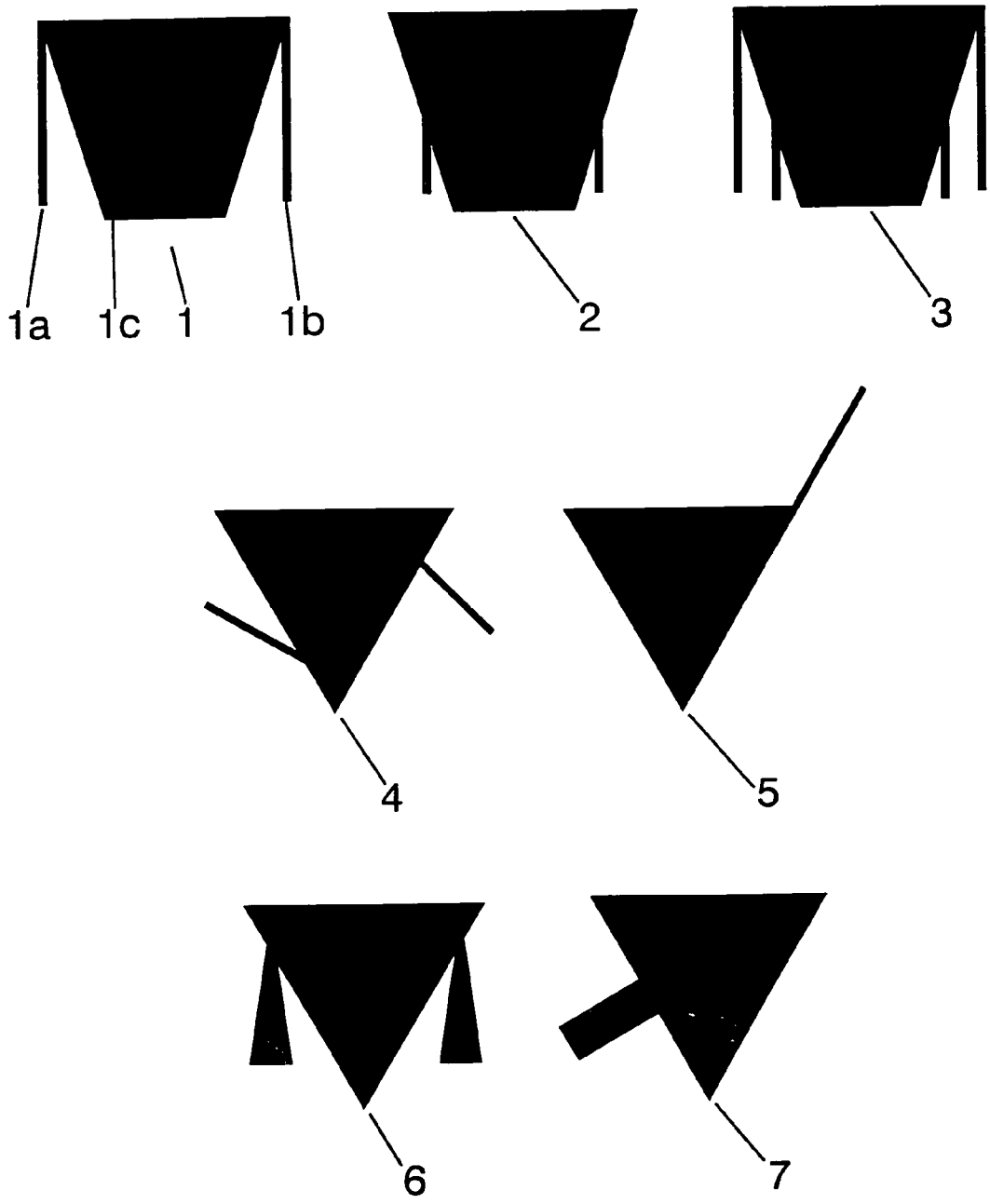
FIG. 1 shows a trapezoid antenna loaded in three different ways using the same structure; in particular, a straight strip. In case 1, one straight strip, the loading structure (1*a*) and (1*b*), is added at each of the tips of the trapezoid, the conducting surface (1*c*). Case 2 is the same as case 1, but using strips with a smaller length and located at a different position around the perimeter of the conducting surface. Case 3, is a more general case where several strips are added to two different locations on the conducting surface. Drawing 4 shows a example of a non-symmetric loaded structure and drawing 5 shows an element where just one slanted strip has been added at the top of the conducting surface. Finally, cases 6 and 7 are examples of geometries loaded with a strip with a triangular and rectangular shape and with different orientations. In these cases, the loads have only one of their ends connected to the conducting surface.
Figure 2:
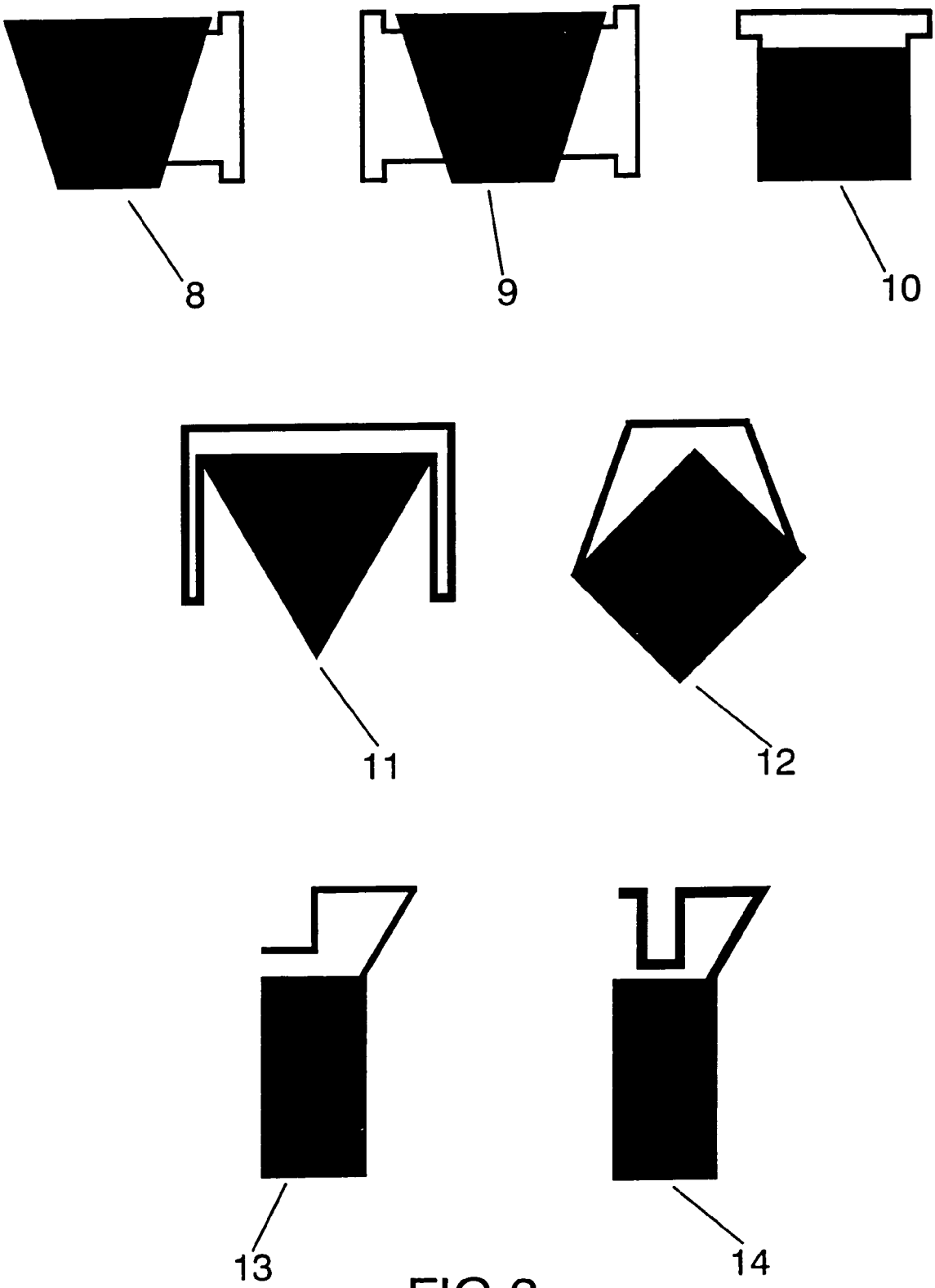
FIG. 2 shows a different particular configuration where the loads are curves which are composed by a maximum of nine segments in such a way that each segment forms an angle with their neighbours, as it has been mentioned before. Moreover, in drawings 8 to 12 the loads have both of their ends connected to the conducting surface. Drawings 8 and 9, are two examples where the conducting surface is side-loaded. Cases 13 and 14, are two cases where a rectangle is top-loaded with an open ended curve, shaped as is mentioned before, with the connection made through one of the tips of the rectangle. The maximum width of the loading strips is smaller than a quarter of the longest edge of the conducting surface.
Figure 3:
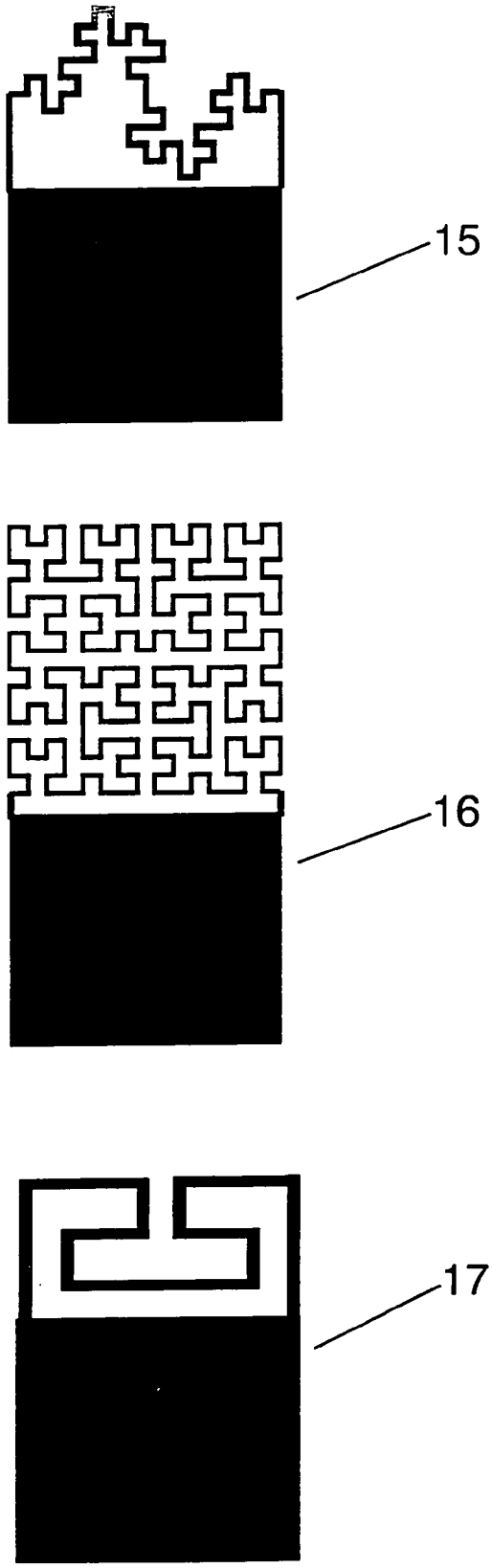
FIG. 3 shows a square structure top-loaded with three different space-filling curves. The curve used to load the square geometry, case 16, is the well-known Hilbert curve.
Figure 4:
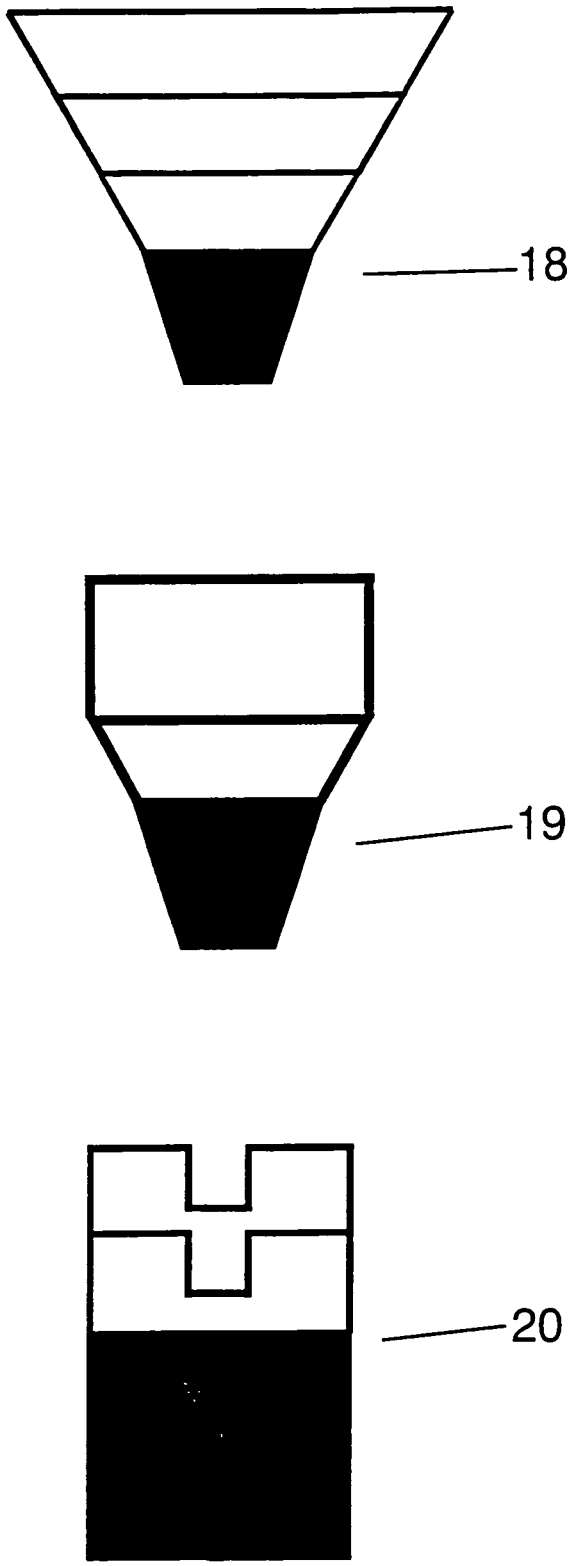
FIG. 4 shows three examples of the top-loaded antenna, where the load consist of two different loads that are added to the conducting surface. In drawing 19, a first load, built with three segments, is added to the trapezoid and then a second load is added to the first one.
Figure 5:
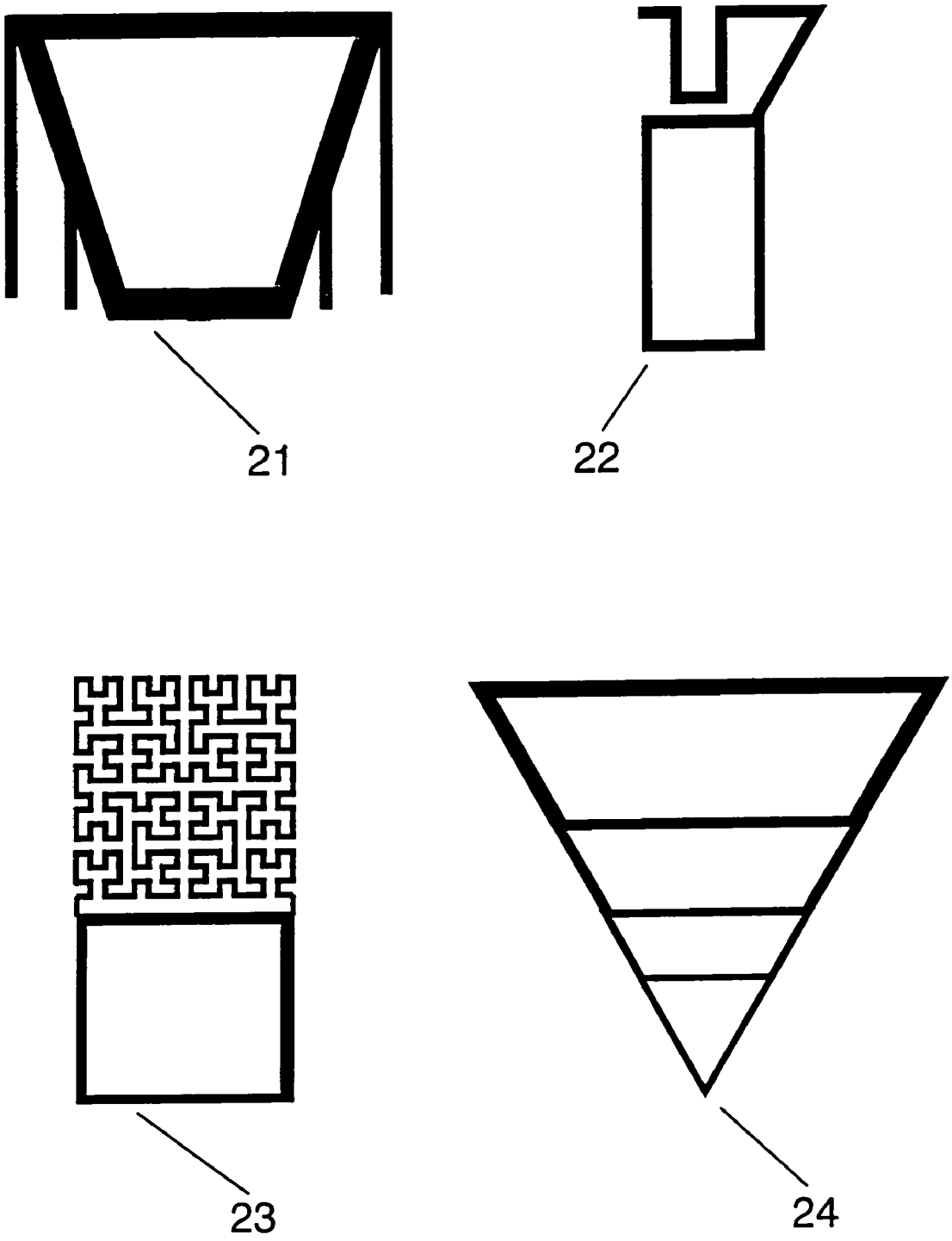
FIG. 5 includes some examples of the loaded antenna where a central portion of the conducting surface is even removed to further reduce the size of the antenna.
Figure 6:
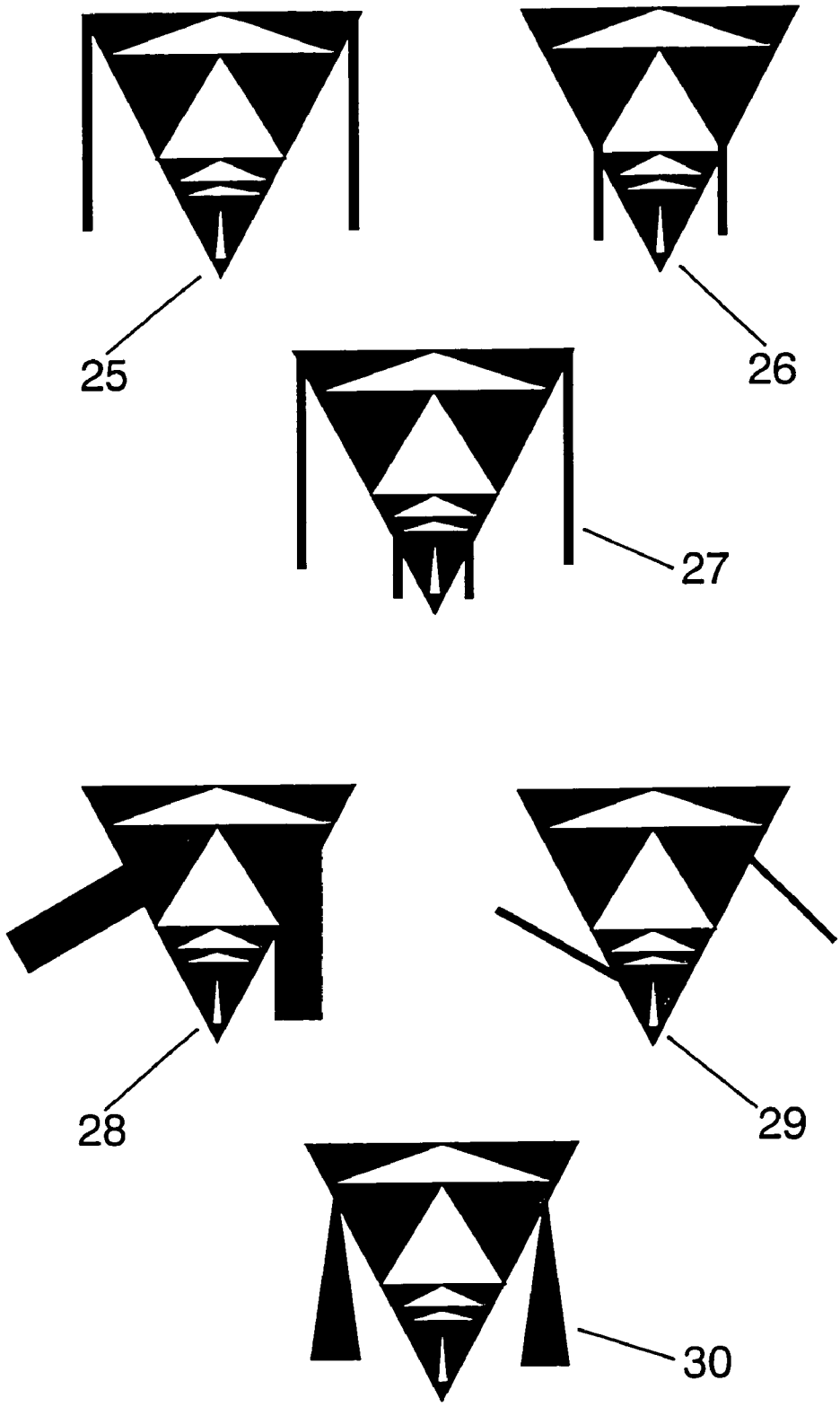
FIG. 6 shows the same loaded antenna described in FIG. 1, but in this case as the conducting surface a multilevel structure is used.
Figure 7:
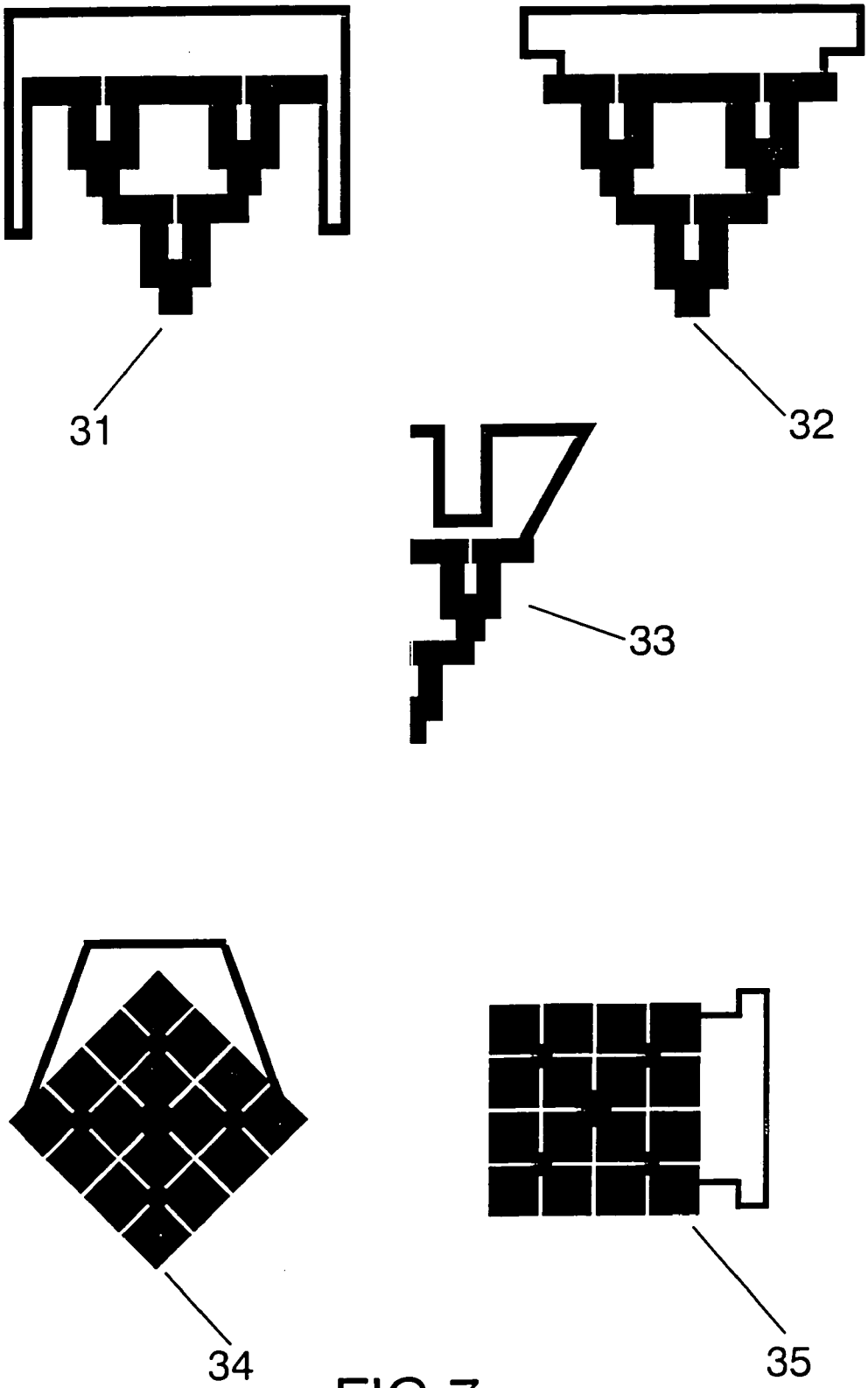
FIG. 7 shows another example of the loaded antenna, similar to those described in FIG. 2. In this case, the conducting surface consist of a multilevel structure. Drawings 31, 32, 34 and 35 use different shapes for the loading but in all cases the load has both ends connected to the conducting surface. Case 33 is an example of an open-ended load added to a multilevel conducting surface.
Figure 8:
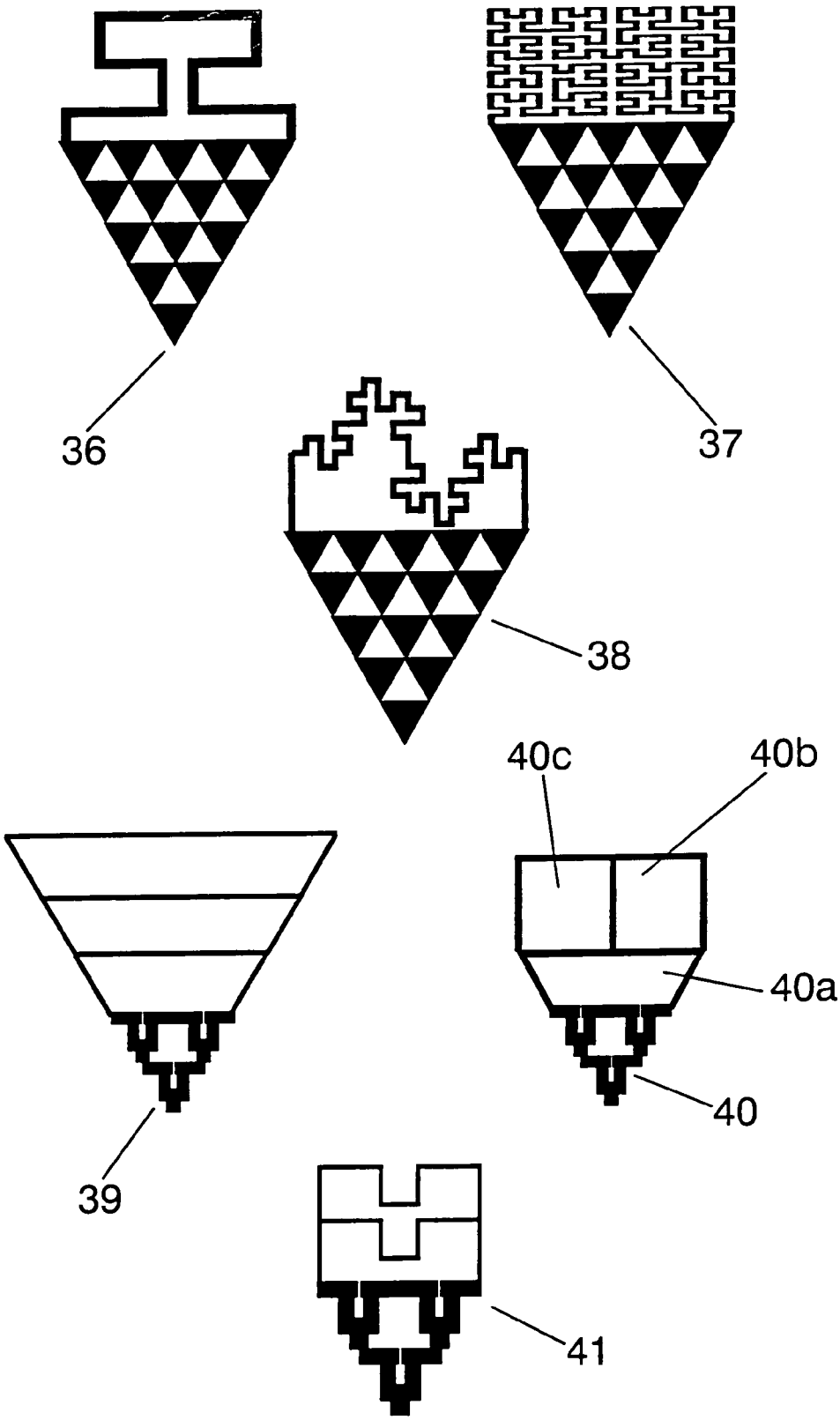
FIG. 8 presents some examples of the loaded antenna, similar to those depicted in FIGS. 3 and 4, but using a multilevel structure as the conducting surface. Illustrations 36, 37 and 38, include a space-filling top-loading curve, while the rest of the drawings show three examples of the top-loaded antenna with several levels of loadings. Drawing 40 is an example where three loads have been added to the multilevel structure. More precisely, the conducting surface is firstly loaded with curve (40*a*), next with curves (40*b*) and (40*c*). Curve (40*a*) has both ends connected to conducting surface, curve (40*b*) has both ends connected to the previous load (40*a*), and load (40*c*), formed with two segments, has one end connected to load (40*a*) and the other to the load (40*b*).
Figure 9:
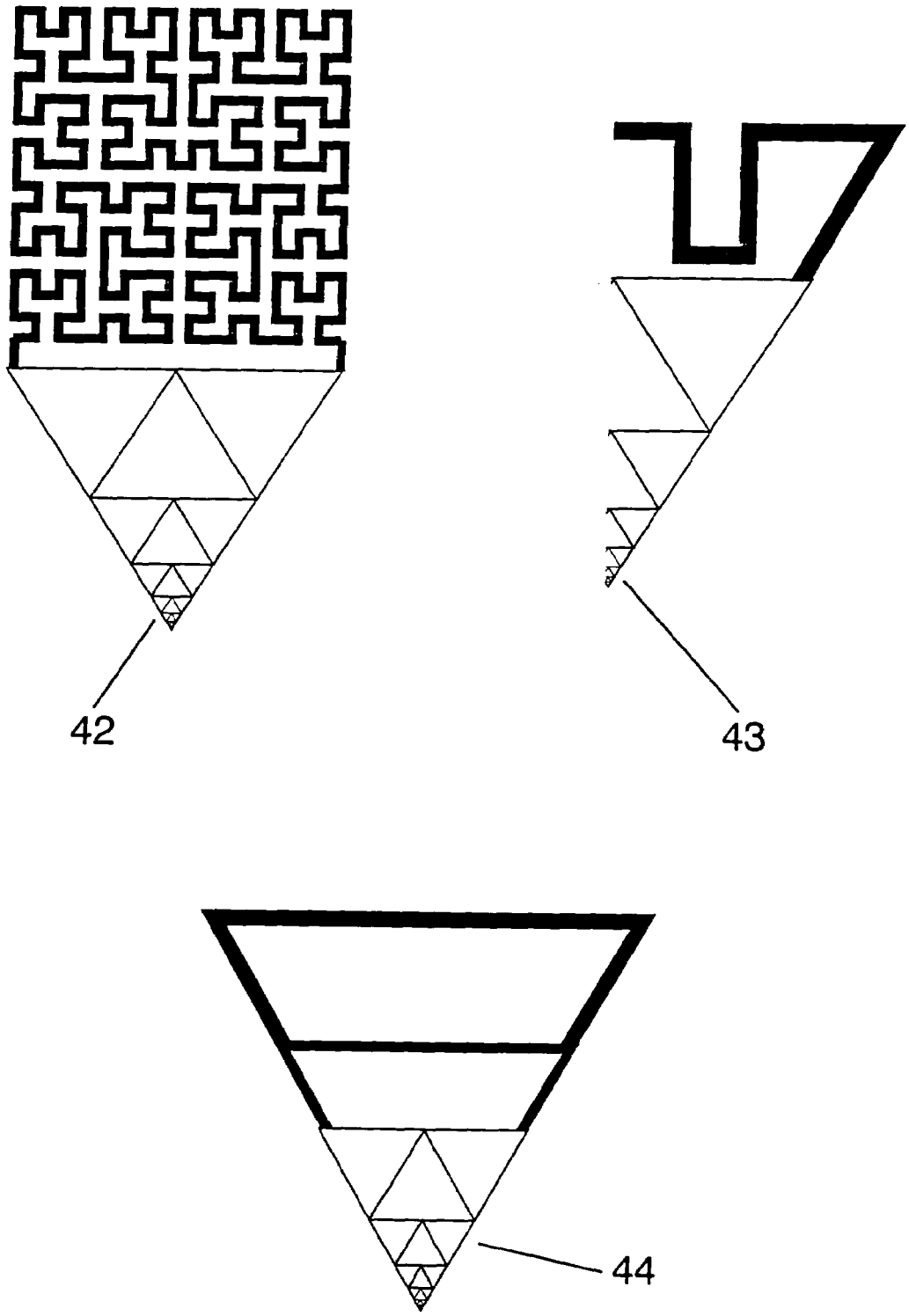
FIG. 9 shows three cases where the same multilevel structure, with the central portions of the conducting surface removed, which is loaded with three different type of loads; those are, a space-filling curve, a curve with a minimum of two segments and a maximum of nine segments connected in such a way mentioned just before, and finally a load with two similar levels.
Figure 10:
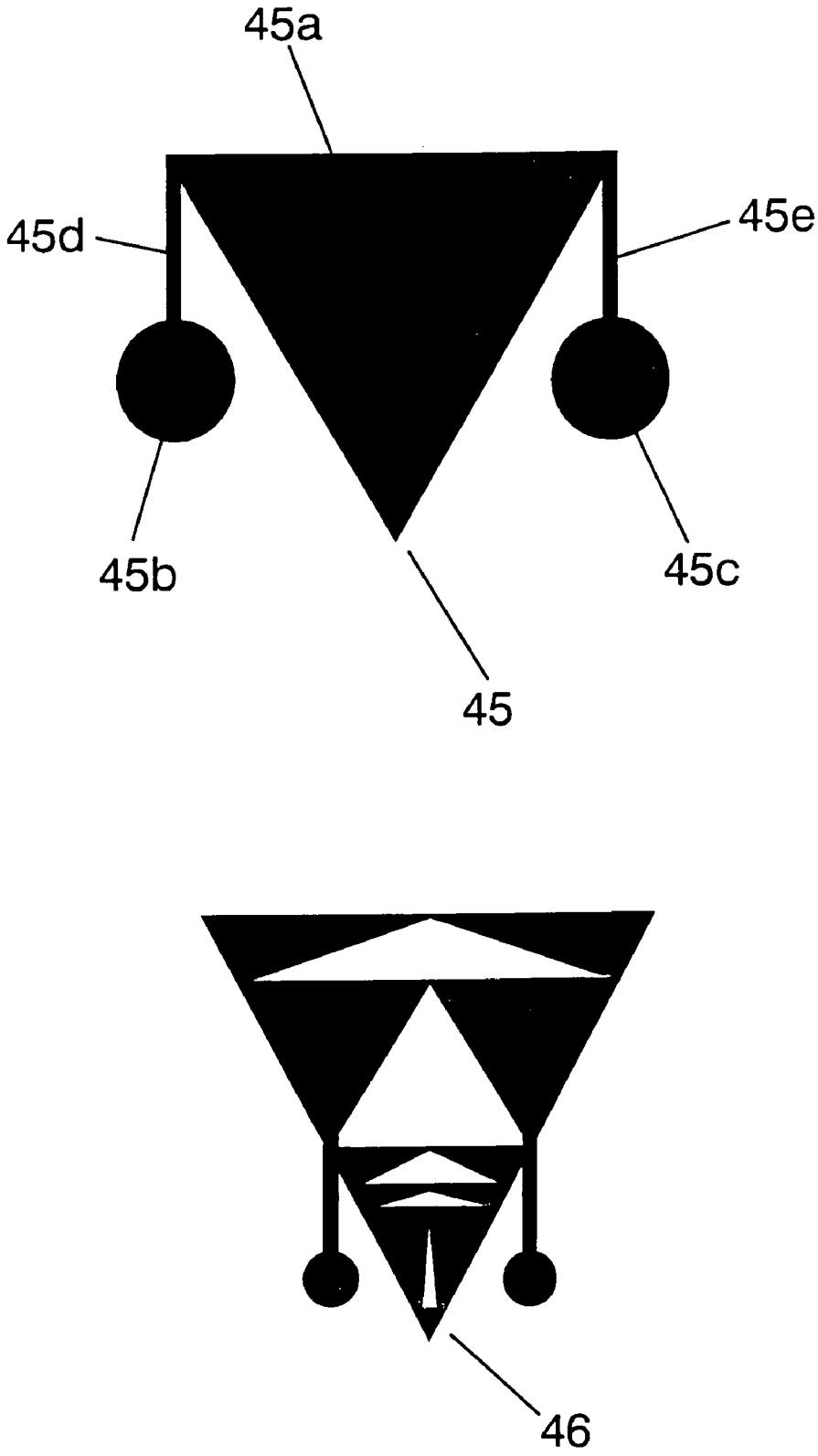
FIG. 10 shows two configurations of the loaded antenna which include three conducting surfaces, one of them bigger than the others. Drawing 45 shows a triangular conducting surface (45*a*) which is connected to two smaller circular conducting surfaces (45*b*) and (45*c*) through one conducting strip (45*d*) and (45*e*). Drawing 46 is a similar configuration to drawing 45 but the bigger conducting surface is a multilevel structure.
Figure 11:
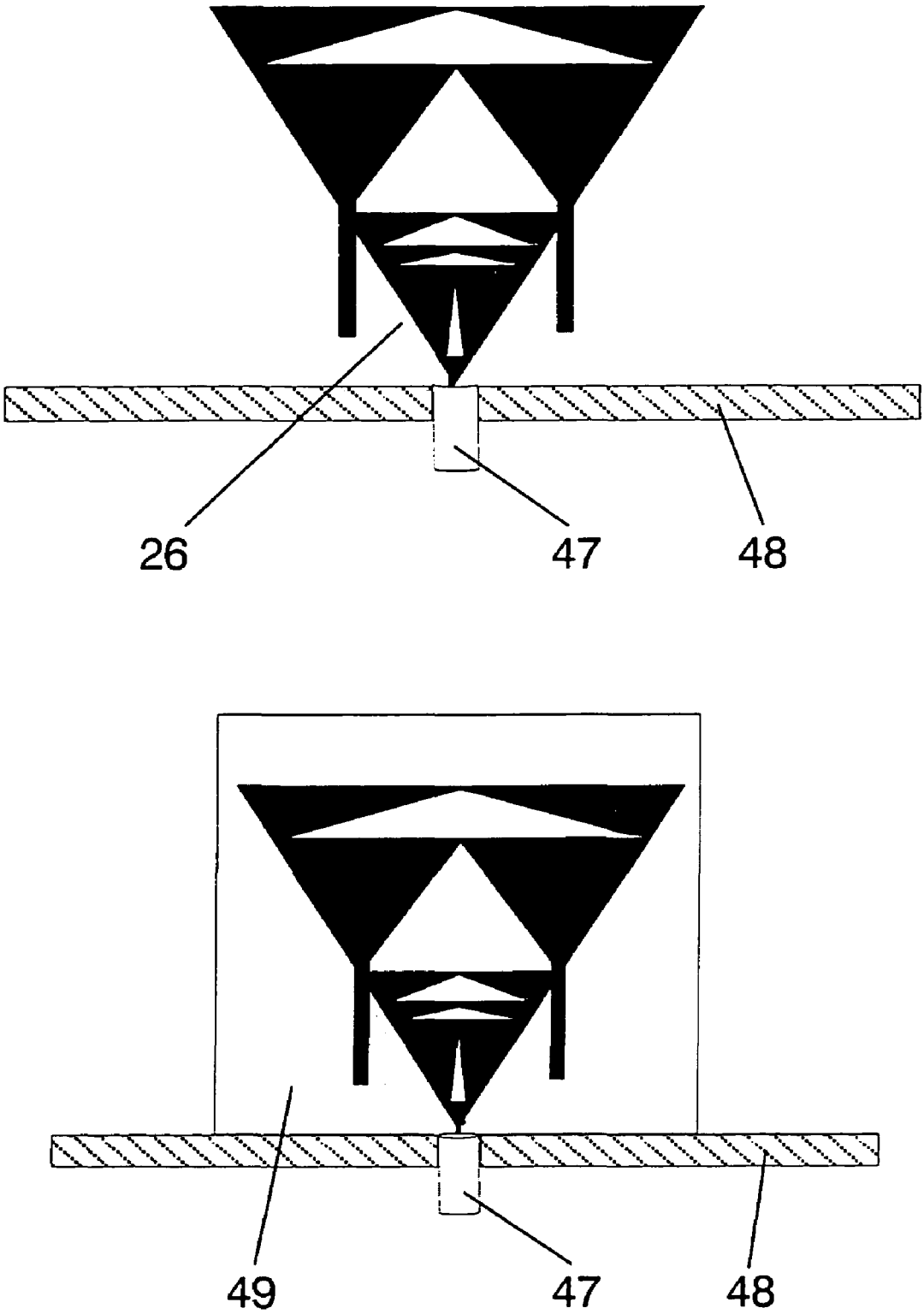
FIG. 11 shows other particular cases of the loaded antenna. They consist of a monopole antenna comprising a conducting or superconducting ground plane (48) with an opening to allocate a coaxial cable (47) with its outer conductor connected to said ground plane and the inner conductor connected to the loaded antenna. The loaded radiator can be optionally placed over a supporting dielectric (49).

A preferred embodiment of the loaded antenna is a monopole configuration as shown in FIG. 11. The antenna includes a conducting or superconducting counterpoise or ground plane (48). A handheld telephone case, or even a part of the metallic structure of a car or train can act as such a ground conterpoise. The ground and the monopole arm (here the arm is represented with the loaded structure (26), but any of the mentioned loaded antenna structure could be taken instead) are excited as usual in prior art monopole by means of, for instance, a transmission line (47). Said transmission line is formed by two conductors, one of the conductors is connected to the ground counterpoise while the other is connected to a point of the conducting or superconducting loaded structure. In FIG. 11, a coaxial cable (47) has been taken as a particular case of transmission line, but it is clear to any skilled in the art that other transmission lines (such as for instance a microstrip arm) could be used to excite the monopole. Optionally, and following the scheme just described, the loaded monopole can be printed over a dielectric substrate (49).

Figure 12:
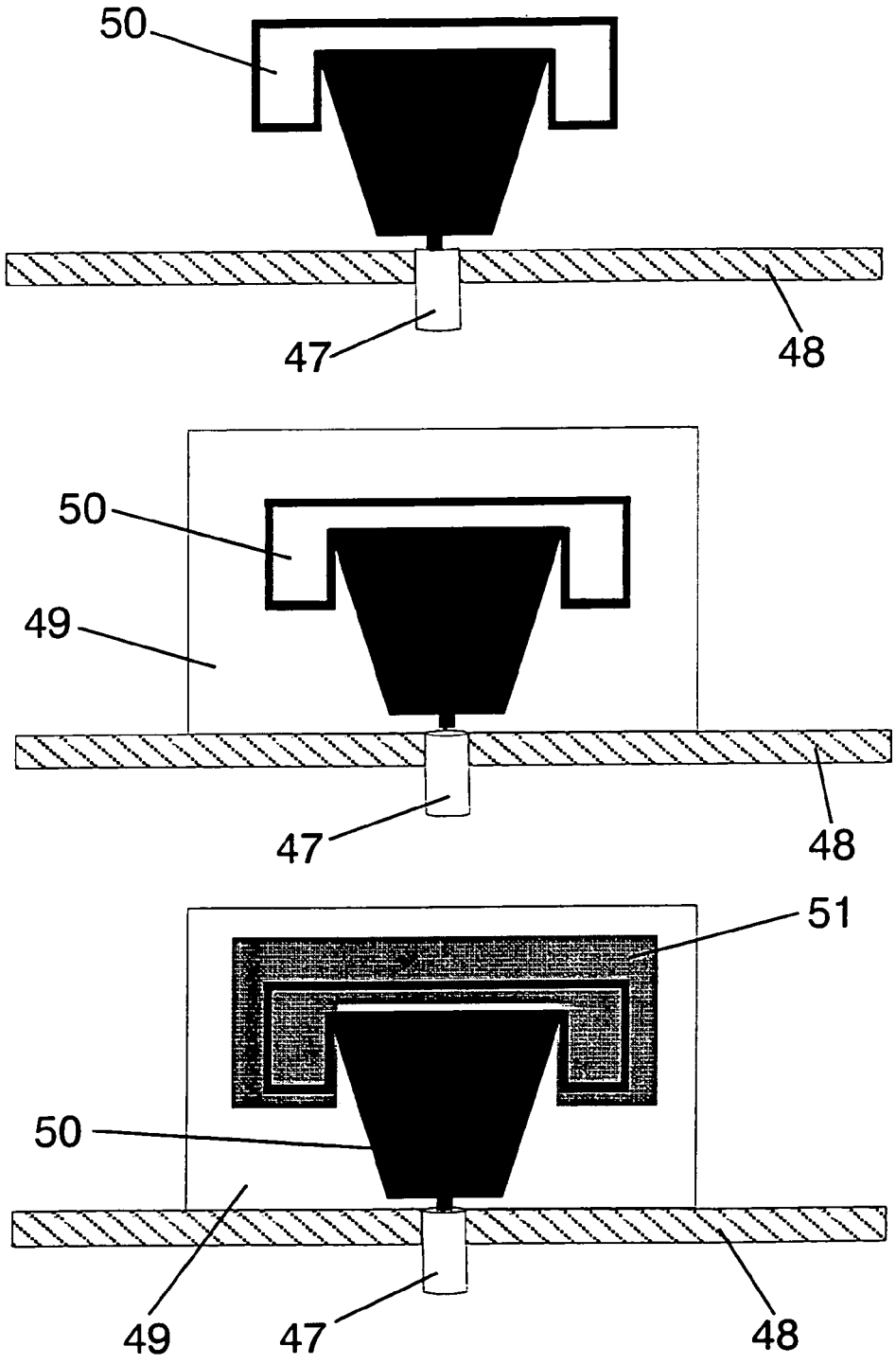
FIG. 12 shows a top-loaded polygonal radiating element (50) mounted with the same configuration as the antenna in FIG. 12. The radiating element radiator can be optionally placed over a supporting dielectric (49). The lower drawing shows a configuration wherein the radiating element is printed on one of the sides of a dielectric substrate (49) and also the load has a conducting surface on the other side of the substrate (51).

Another preferred embodiment of the loaded antenna is a monopole configuration as shown in FIG. 12. The assembly of the antenna (feeding scheme, ground plane, etc) is the same as the considered in the embodiment described in FIG. 11. In the present figure, there is another example of the loaded antenna. More precisely, it consists of a trapezoid element top-loaded with one of the mentioned curves. In this case, one of the main differences is that, being the antenna edged on dielectric substrate, it also includes a conducting surface on the other side of the dielectric (51) with the shape of the load. This preferred configuration allows to miniaturize the antenna and also to adjust the multiband parameters of the antenna, such as the spacing the between bands.

Figure 13:
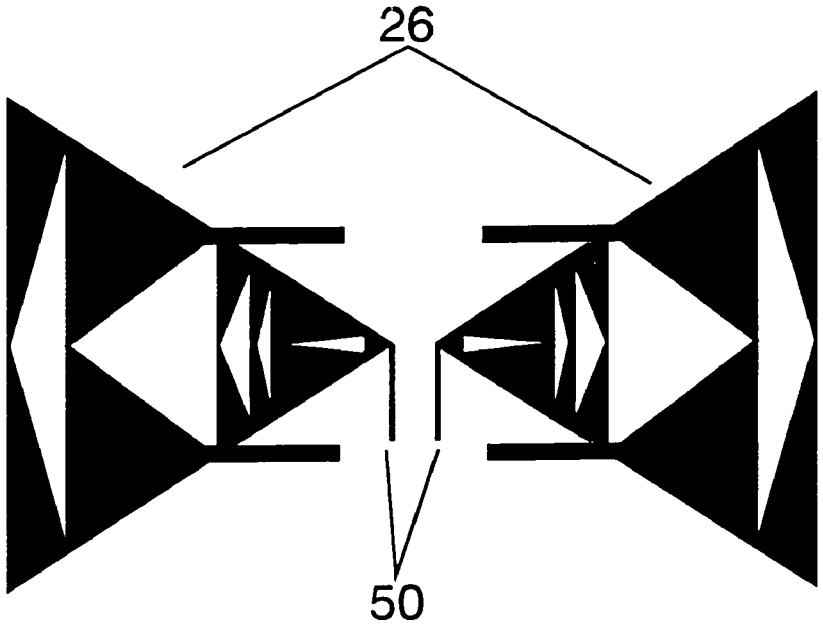
FIG. 13 shows a particular configuration of the loaded antenna. It consists of a dipole wherein each of the two arms includes two straight strip loads. The lines at the vertex of the small triangles (50) indicate the input terminal points. The two drawings display different configurations of the same basic dipole; in the lower drawing the radiating element is supported by a dielectric substrate (49).
Figure 13:
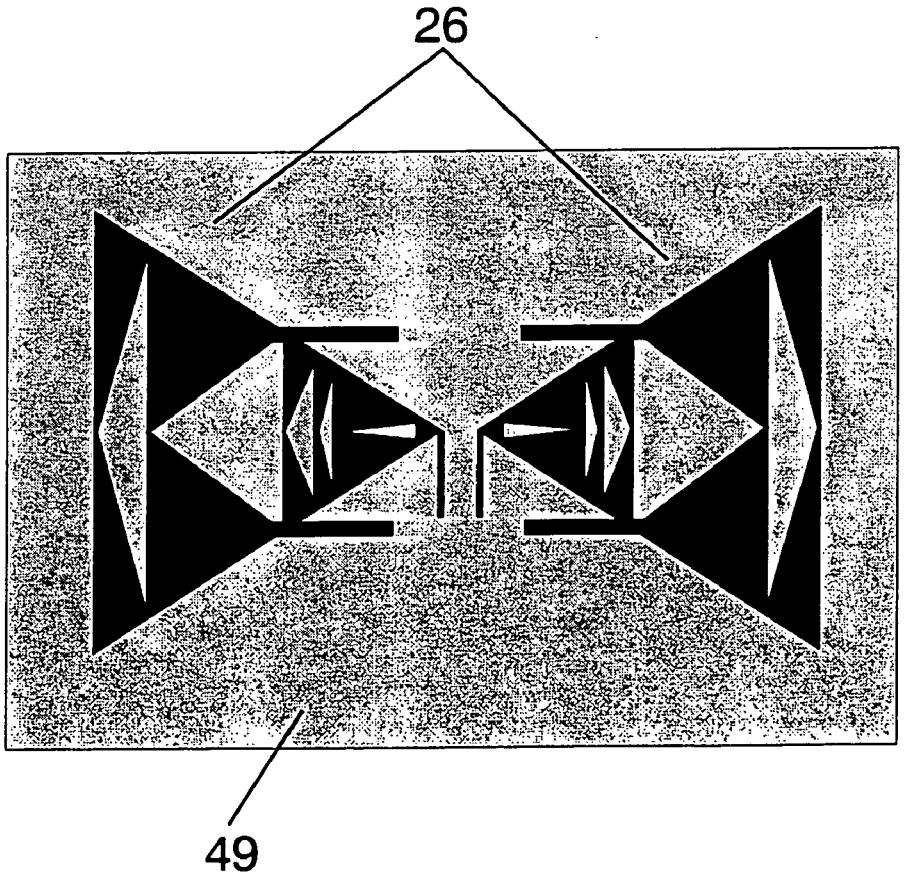

FIG. 13 describes a preferred embodiment of the invention. A two-arm antenna dipole is constructed comprising two conducting or superconducting parts, each part being a side-loaded multilevel structure. For the sake of clarity but without loss of generality, a particular case of the loaded antenna (26) has been chosen here; obviously, other structures, as for instance, those described in FIGS. 2, 3, 4, 7 and 8, could be used instead. Both, the conducting surfaces and the loading structures are lying on the same surface. The two closest apexes of the two arms form the input terminals (50) of the dipole. The terminals (50) have been drawn as conducting or superconducting wires, but as it is clear to those skilled in the art, such terminals could be shaped following any other pattern as long as they are kept small in terms of the operating wavelength. The skilled in the art will notice that, the arms of the dipoles can be rotated and folded in different ways to finely modify the input impedance or the radiation properties of the antenna such as, for instance, polarization.

Another preferred embodiment of a loaded dipole is also shown in FIG. 13 where the conducting or superconducting loaded arms are printed over a dielectric substrate (49); this method is particularly convenient in terms of cost and mechanical robustness when the shape of the applied load packs a long length in a small area and when the conducting surface contains a high number of polygons, as happens with multilevel structures. Any of the well-known printed circuit fabrication techniques can be applied to pattern the loaded structure over the dielectric substrate. Said dielectric substrate can be, for instance, a glass-fibre board, a teflon based substrate (such as Cuclad®) or other standard radiofrequency and microwave substrates (as for instance Rogers 4003® or Kapton®). The dielectric substrate can be a portion of a window glass if the antenna is to be mounted in a motor vehicle such as a car, a train or an airplane, to transmit or receive radio, TV, cellular telephone (GSM900, GSM1800, UMTS) or other communication services electromagnetic waves. Of course, a balun network can be connected or integrated at the input terminals of the dipole to balance the current distribution among the two dipole arms.

Figure 14:
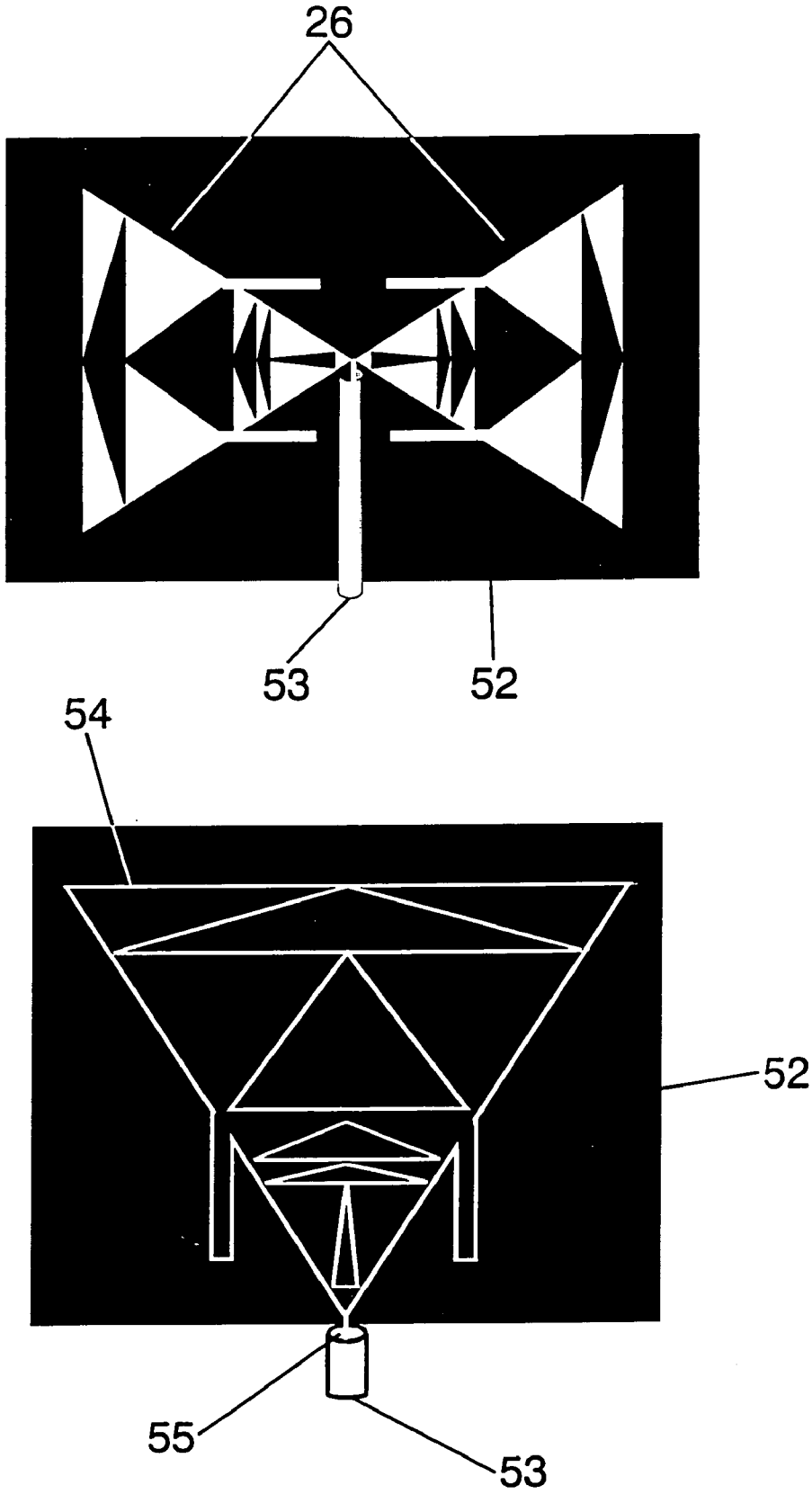
FIG. 14 shows, in the upper drawing, an example of the same dipole antenna side-loaded with two strips but fed as an aperture antenna. The lower drawing is the same loaded structure wherein the conductor defines the perimeter of the loaded geometry.

The embodiment (26) in FIG. 14 consist on an aperture configuration of a loaded antenna using a multilevel geometry as the conducting surface. The feeding techniques can be one of the techniques usually used in conventional aperture antennas. In the described figure, the inner conductor of the coaxial cable (53) is directly connected to the lower triangular element and the outer conductor to the rest of the conductive surface. Other feeding configurations are possible, such as for instance a capacitive coupling.

Another preferred embodiment of the loaded antenna is a slot loaded monopole antenna as shown in the lower drawing in FIG. 14. In this figure the loaded structure forms a slot or gap (54) impressed over a conducting or superconducting sheet (52). Such sheet can be, for instance, a sheet over a dielectric substrate in a printed circuit board configuration, a transparent conductive film such as those deposited over a glass window to protect the interior of a car from heating infrared radiation, or can even be a part of the metallic structure of a handheld telephone, a car, train, boat or airplane. The feeding scheme can be any of the well known in conventional slot antennas and it does not become an essential part of the present invention. In all said two illustrations in FIG. 14, a coaxial cable has been used to feed the antenna, with one of the conductors connected to one side of the conducting sheet and the other connected at the other side of the sheet across the slot. A microstrip transmission line could be used, for instance, instead of a coaxial cable.

Figure 15:
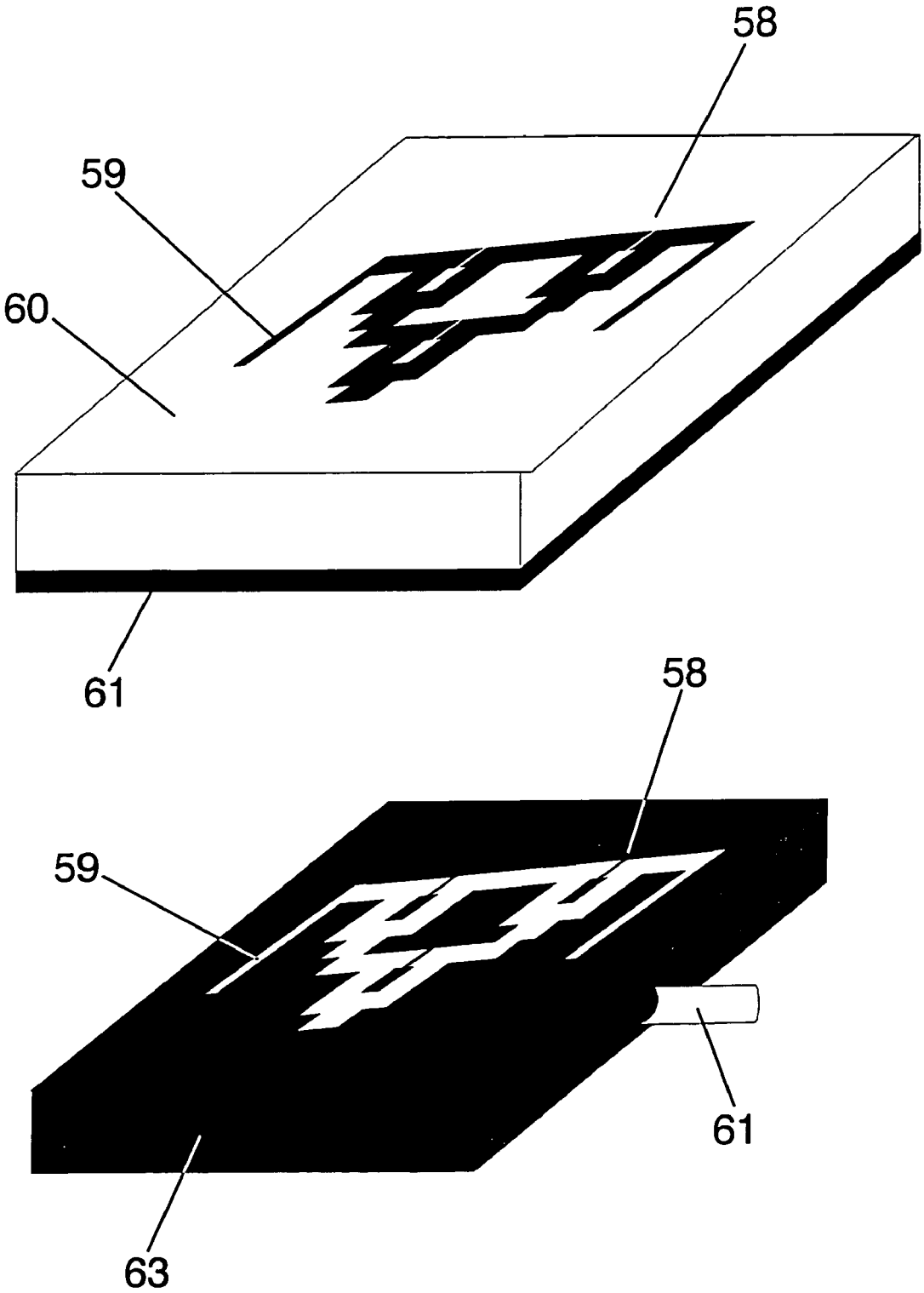
FIG. 15 shows a patch antenna wherein the radiating element is a multilevel structure top-loaded with two strip arms, upper drawing. Also, the figure shows an aperture antenna wherein the aperture (59) is practiced on a conducting or superconducting structure (63), said aperture being shaped as a loaded multilevel structure.

Another preferred embodiment is described in FIG. 15. It consists of a patch antenna, with the conducting or superconducting patch (58) featuring the loaded structure (the particular case of the loaded structure (59) has been used here but it is clear that any of the other mentioned structures could be used instead). The patch antenna comprises a conducting or superconducting ground plane (61) or ground counterpoise, and the conducting or superconducting patch which is parallel to said ground plane or ground counterpoise. The spacing between the patch and the ground is typically below (but not restricted to) a quarter wavelength. Optionally, a low-loss dielectric substrate (60) (such as glass-fibre, a teflon substrate such as Cuclad® or other commercial materials such as Rogers4003®) can be placed between said patch and ground counterpoise. The antenna feeding scheme can be taken to be any of the well-known schemes used in prior art patch antennas, for instance: a coaxial cable with the outer conductor connected to the ground plane and the inner conductor connected to the patch at the desired input resistance point (of course the typical modifications including a capacitive gap on the patch around the coaxial connecting point or a capacitive plate connected to the inner conductor of the coaxial placed at a distance parallel to the patch, and so on, can be used as well); a microstrip transmission line sharing the same ground plane as the antenna with the strip capacitively coupled to the patch and located at a distance below the patch, or in another embodiment with the strip placed below the ground plane and coupled to the patch through a slot, and even a microstrip line with the strip co-planar to the patch. All these mechanisms are well known from prior art and do not constitute an essential part of the present invention. The essential part of the invention is the loading shape of the antenna which contributes to enhance the behavior of the radiator to operate simultaneously at several bands with a small size performance.

The same FIG. 15 describes another preferred embodiment of the loaded antenna. It consist of an aperture antenna, said aperture being characterized by its loading added to a multilevel structure, said aperture being impressed over a conducting ground plane or ground counterpoise, said ground plane consisting, for example, of a wall of a waveguide or cavity resonator or a part of the structure of a motor vehicle (such as a car, a lorry, an airplane or a tank). The aperture can be fed by any of the conventional techniques such as a coaxial cable (61), or a planar microstrip or strip-line transmission line, to name a few.

Figure 16:
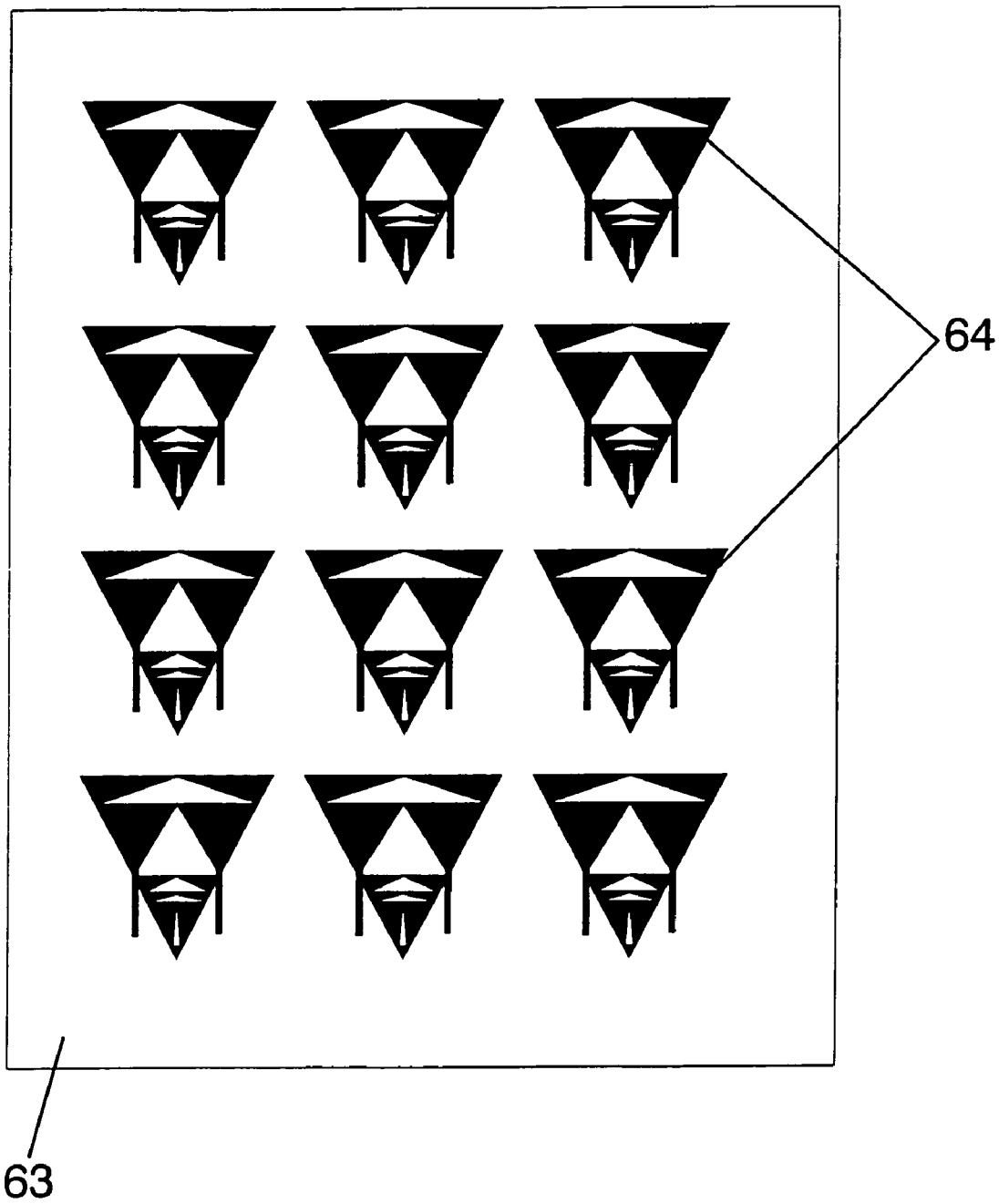
FIG. 16 shows a frequency selective surface wherein the elements that form the surface are shaped as a multilevel loaded structure.

Another preferred embodiment is described in FIG. 16. It consists of a frequency selective surface (63). Frequency selective surfaces are essentially electromagnetic filters, which at some frequencies they completely reflect energy while at other frequencies they are completely transparent. In this preferred embodiment the selective elements (64), which form the surface (63), use the loaded structure (26), but any other of the mentioned loaded antenna structures can be used instead. At least one of the selective elements (64) has the same shape of the mentioned loaded radiating elements. Besides this embodiment, another embodiment is preferred; this is, a loaded antenna where the conducting surface or the loading structure, or both, are shaped by means of one or a combination of the following mathematical algorithms: Iterated Function Systems, Multi Reduction Copy Machine, Networked Multi Reduction Copy Machine.

The invention claimed is:

1. A loaded antenna comprising:

a radiating element comprising a first part and a second part;

the first part comprising at least one conducting surface; and the second part comprising a loading structure, the loading structure comprising at least one conducting strip connected at at least one point on an edge of the at least one conducting surface, the maximal width of the at least one conducting strip being less than a quarter of the longest straight edge of the conducting surface; and wherein at least a portion of the at least one conducting surface is a multilevel structure comprising a plurality of polygons, all of the plurality of polygons having at least four and the same number of sides, a plurality of the plurality of polygons being electromagnetically coupled via capacitive coupling or ohmic contact to define a plurality of contact regions and wherein, for at least 75% of the plurality of electromagnetically coupled polygons, a contact region is less than 50% of the perimeter of an electromagnetically coupled polygon.

2. The loaded antenna of claim 1, wherein:

a shape of at least one of the at least one conducting strip comprises a curve;

wherein the curve comprises a minimum of two segments and a maximum of nine segments; and wherein each segment forms an angle with an adjacent segment so that no pair of adjacent segments defines a larger straight segment.

3. The loaded antenna of claim 1, wherein two tips of at least one of the at least one conducting strip are connected at two points on a perimeter of the first part.

4. The loaded antenna of claim 1, wherein:

the loading structure comprises at least two conducting strips; and a tip of a first of the at least two conducting strips and a tip of a second of the at least two conducting strips are connected.

5. The loaded antenna of claim 1, wherein:

the loading structure comprises at least two conducting strips; and both tips of a first of the at least two conducting strips are connected to a second of the at least two conducting strips.

6. The loaded antenna of claim 1, wherein:

the loading structure comprises at least two conducting strips; and a first tip of a first of the at least two conducting strips is connected to a second of the at least two conducting strips; and a second tip of the first of the at least two conducting strips is connected to the at least one conducting surface.

7. The loaded antenna of claim 1, wherein the loading structure comprises at least two conducting strips connected at a plurality of points on a perimeter of the at least one conducting surface.

8. The loaded antenna of claim 1, wherein at least one conducting surface and the loading structure are lying on a common flat or curved surface.

9. The loaded antenna of claim 1, wherein:

the antenna comprises at least two conducting surfaces;

a second conducting surface of the at least two conducting surfaces features a smaller area than a first conducting surface of the at least two conducting surfaces; and at least one conducting strip of the at least one conducting strip is connected to the first conducting surface at a first end and to the second conducting surface at a second end.

10. The loaded antenna of claim 1, wherein a perimeter of the at least one conducting surface is of shaped as one of a triangle, a square, a rectangle, a trapezoid, a pentagon, a hexagon, a heptagon, an octagon, a circle, and an ellipse.

11. The loaded antenna of claim 1, wherein, due to the loading structure, the loaded antenna has a multiband behavior involving more operating bands compared to an identical antenna without the loading structure.

12. A loaded antenna comprising:

a radiating element comprising a first part and a second part;

the first part comprising at least one conducting surface; and the second part comprising a loading structure, the loading structure comprising at least one conducting strip connected at at least one point on an edge of the at least one conducting surface, the maximal width of the at least one conducting strip being less than a quarter of the longest straight edge of the conducting surface;

wherein the at least one conducting strip is shaped as a space-filling curve comprising at least ten segments connected so that no pair of adjacent segments defines a longer straight segment and, if the curve is periodic along a fixed straight direction of space, the period is defined by a non-periodic curve comprising at least ten connected segments and no pair of the adjacent and connected segments defines a straight longer segment; and wherein the space-filling curve intersects with itself at most only at its initial and final point.

13. The loaded antenna of claim 12, wherein a perimeter of the at least one conducting surface is polygonal in shape.

14. The loaded antenna of claim 12, wherein at least a part of a perimeter of the at least one conducting surface is shaped as a space-filling curve.

15. The loaded antenna of claim 12, wherein at least a portion of the at least one conducting surface is shaped as a multilevel structure.

16. The loaded antenna of claim 12, wherein two tips of at least one of the at least one conducting strip are connected at two points on a perimeter of the at least one conducting surface.

17. The loaded antenna of claim 12, wherein the at least one conducting surface and the loading structure are lying on a common flat or curved surface.

18. The loaded antenna of claim 12, wherein:

the at least one conducting strip comprises a first conducting strip and a second conducting strip;

the first conducting strip is connected at at least one point to a perimeter of the at least one conducting surface; and a tip of the second conducting strip is connected to the first conducting strip.

19. The loaded antenna of claim 12, wherein:

the at least one conducting surface comprises a first conducting surface and a second conducting surface;

the second conducting surface has a smaller area than the first conducting surface; and the at least one conducting strip is connected to the first conducting surface at a first end and to the second conducting surface at a second end.

20. The loaded antenna of claim 12, wherein, due to the loading structure, the loaded antenna has a multiband behavior involving more operating bands compared to an identical antenna without the loading structure.

21. A loaded antenna comprising:

a radiating element comprising a first part and a second part;

the first part comprising at least one conducting surface; and the second part comprising a loading structure, the loading structure comprising at least one conducting strip connected at at least one point on an edge of the at least one conducting surface, the maximal width of the at least one conducting strip being less than a quarter of the longest straight edge of the conducting surface; and wherein at least a portion of the at least one conducting surface is a multilevel structure comprising a plurality of polygons, all of the plurality of polygons having at least four and the same number of sides, the plurality of polygons being generally identifiable by the free perimeter thereof as a geometrical element and wherein projection of the exposed perimeters of the plurality of polygons defines the least number of polygons necessary to form a generally distinguishable element where polygon perimeters are interconnected, a plurality of the plurality of polygons being electromagnetically coupled via capacitive coupling or ohmic contact to define a plurality of contact regions and wherein, for at least 75% of the plurality of electromagnetically coupled polygons, a contact region is less than 50% of the perimeter of an electromagnetically coupled polygon.

* * * * *

US007312762C1

(12) INTER PARTES REEXAMINATION CERTIFICATE (487th)

United States Patent

Ballarda et al.

(10) Number: US 7,312,762 C1

(45) Certificate Issued: Nov. 9, 2012

(54) LOADED ANTENNA

(75) Inventors: Carles Puente Ballarda, Barcelona (ES); Jordi Soler Castany, Barcelona (ES)

(73) Assignee: Fractus, S.A., Sant Cugat del Valles (ES)

Reexamination Request:
No. 95/001,461, Oct. 1, 2010
No. 95/000,587, Dec. 15, 2010

Reexamination Certificate for:

| | |
|---|---|
| Patent No.: | **7,312,762** |
| Issued: | **Dec. 25, 2007** |
| Appl. No.: | **10/822,933** |
| Filed: | **Apr. 13, 2004** |

Related U.S. Application Data

(63) Continuation of application No. PCT/EP01/11914, filed on Oct. 16, 2001.

(30) Foreign Application Priority Data

Oct. 16, 2001 (WO) ..... PCT/EP2001/011914

(51) Int. Cl.
*H01Q 9/42* (2006.01)

(52) U.S. Cl. ..... 343/752; 343/792.5

(58) Field of Classification Search ..... None
See application file for complete search history.

(56) References Cited

To view the complete listing of prior art documents cited during the proceedings for Reexamination Control Numbers 95/001,461 and 95/000,587, please refer to the USPTO's public Patent Application Information Retrieval (PAIR) system under the Display References tab.

*Primary Examiner* — James Menefee

(57) ABSTRACT

A novel loaded antenna is defined in the present invention. The radiating element of the loaded antenna consists of two different parts: a conducting surface and a loading structure. By means of this configuration, the antenna provides a small and multiband performance, and hence it features a similar behaviour through different frequency bands.

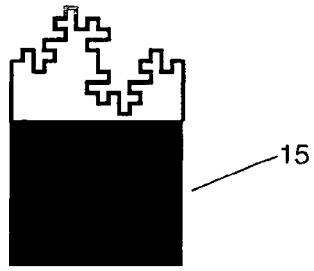

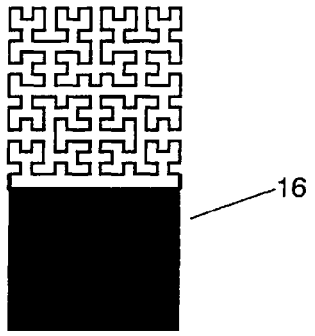

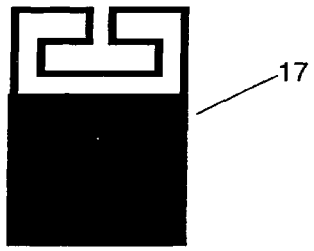

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1, 7, 8, 11, 12, 14, 15, 17 and 21 are cancelled.

Claims 2-6, 9, 10, 13, 16 and 18-20 were not reexamined.

* * * * *